United States Patent [19]

Miyai et al.

[11] Patent Number: 4,761,667

[45] Date of Patent: Aug. 2, 1988

[54] IMAGE FORMING APPARATUS

[75] Inventors: Kiyoshi Miyai; Shuhei Uotani, both of Himeji; Toyohiko Tsunemine; Yujiro Kohmoto, both of Hyogo, all of Japan

[73] Assignee: Sanyo Electric Co., Ltd., Japan

[21] Appl. No.: 933,312

[22] Filed: Nov. 19, 1986

Related U.S. Application Data

[63] Continuation of Ser. No. 750,879, Jul. 1, 1985, abandoned.

[51] Int. Cl.[4] ..... G03G 15/00

[52] U.S. Cl. ..... 355/3 R; 355/3 SH; 271/311; 271/900

[58] Field of Search ..... 355/3 R, 3 DR, 3 SH, 355/3 TR, 15; 271/307, 308, 311, 312, 313, 900

[56] References Cited

U.S. PATENT DOCUMENTS 3,918,702 11/1975 Mihalik et al. ..... 271/311
3,955,889 5/1976 Ishiguro et al. ..... 271/900 X
4,327,991 5/1982 Takeuchi et al. ..... 355/3 TR X
4,386,838 7/1983 Hirabayashi et al. ..... 35/3 DR
4,456,363 6/1984 Hirabayashi ..... 355/3 SH X
4,470,689 9/1984 Nomura et al. ..... 355/3 DR X

FOREIGN PATENT DOCUMENTS 55-69176 5/1980 Japan ..... 271/311

*Primary Examiner*—Arthur T. Grimley
*Assistant Examiner*—J. Pendegrass
*Attorney, Agent, or Firm*—Darby & Darby

[57] ABSTRACT

An image forming apparatus includes a detachable sub-assembly consisting of a latent image holder drum and cleaning means in a unitary assembly, whereby after the sub-assembly is removed from the image forming apparatus, the cleaning device and latent image holder drum can be individually separated from the sub-assembly. Also, a peel-off device is mounted on the sub-assembly for peeling recording paper away from the latent image holder drum.

13 Claims, 6 Drawing Sheets

IMAGE FORMING APPARATUS

This is a continuation of application Ser. No. 750,879 filed July 1, 1985, now abandoned.

BACKGROUND OF THE INVENTION

1. Field of the Invention

This invention relates to an image forming apparatus, such as mainly a copier and a printer and so on, comprising a latent image holder and a cleaning means integral with each other to adopt the so-called process kit.

2. Description of the Prior Art

The image forming apparatus, such as copier periodically carries out exchange of a latent image holder (usually drum-like-shaped), supply of toner and developer, discard of waste toner, and exchange and maintenance of other several parts. In the conventional apparatus, above exchange and maintenance of these parts have been carried out by a service man of professional knowledge who goes to the site each time, which has been very troublesome and increased a maintenance and administrative cost.

Under the above circumstances, construction such that the latent image holder and a cleaning means, or a toner hopper and a developing means, are coupled in unit so that each one unit is exchanged in batch, has been put into practical use. Hence, a user can exchange simply by himself the main components necessary for periodical maintenance, whereby exchange and maintenance by a service man is not necessary, and it is possible that a user prepares toner of various colors filled in different units and uses them properly.

In the above-mentioned construction, parts included in the same unit, for example, the latent image holder and cleaning means are not always equal in a life time, so that when one of them causes trouble or breakage for some reason, the other, even still usable, has to be discarded. Hence, such construction is rather uneconomical and may cause a high maintenance cost in comparison with conventional image forming apparatus.

On the other hand, the apparatus of the latent image holder and cleaning means coupled in unit has a great fear that, when the unit is mounted or dismounted to or from the apparatus body, the latent image holder may be injured at the surface. In detail, the conventional apparatus is provided at the body with a peel-off device for peeling off a recording paper from the surface of the latent image holder during the operation for image forming, whereby the peel-off device slidably contacts with the surface of the latent image holder axially thereof each time the latent image holder is exchanged. Hence, a flaw is liable to be created on the surface of the latent image holder axially thereof, thereby causing deterioration of the quality of the image forming on the recording paper. Also, it is required to exactly maintain the relative positional relation between the latent image holder and the peel-off device, but there is a great fear that the positional relation between both the parts is out of order as the latent image holder often is mounted or dismounted to or from the body. When the latent image holder and peel-off device have therebetween the inaccurate positional relation, the recording paper is peeled off not-reliably from the latent image holder, thereby causing paper jamming and breakage thereby on the latent image holder.

SUMMARY OF THE INVENTION

A first object of the invention is to provide an image forming apparatus which is capable of separating as required a latent image holder and a cleaning means from each other, which conventionally are integral with each other to be detachably mounted on a body of the apparatus, whereby unnecessary exchange of part is avoided to reduce a maintenance cost and be more inexpensive.

A second object of the invention is to provide an image forming apparatus which mounts a peel-off device on a side of a unit including the latent image holder, so that even when the unit including the latent image holder is mounted or dismounted to or from the body, there is no fear that the surface of the latent image holder is not injured by the peel-off device.

A third object of the invention is to provide an image forming apparatus which keeps with accuracy the relative positional relation between the latent image holder and the peel-off device so that the recording paper is peeled off reliably from the latent image holder, whereby the recording paper is less jammed.

A fourth object of the invention is to provide an image forming apparatus which prevents breakage on the surface of the latent image holder when exchanged, thereby prolonging a life time thereof.

A fifth object of the invention is to provide an image forming apparatus which makes constant a biasing force of the peel-off device applied onto the surface of the latent image holder, thereby enabling the recording paper to be stably peeled off from the latent image holder.

The present invention satisfies the above objects by including in a detachable and unitary sub-assembly a latent image holder and cleaning means, whereby after detachment of the sub-assembly from the image forming apparatus, the latent image holder and cleaning means are individually separable from the sub-assembly.

The above and further objects and features of the invention will more fully be apparent from the following detailed description with reference to accompanying drawings.

DETAILED DESCRIPTION OF THE INVENTION

Next, explanation will be given on an embodiment of the invention applied to a copier. The image forming apparatus of the invention of course is applicable to, for example, a printer as well as the aforesaid copier.

Figure 1:
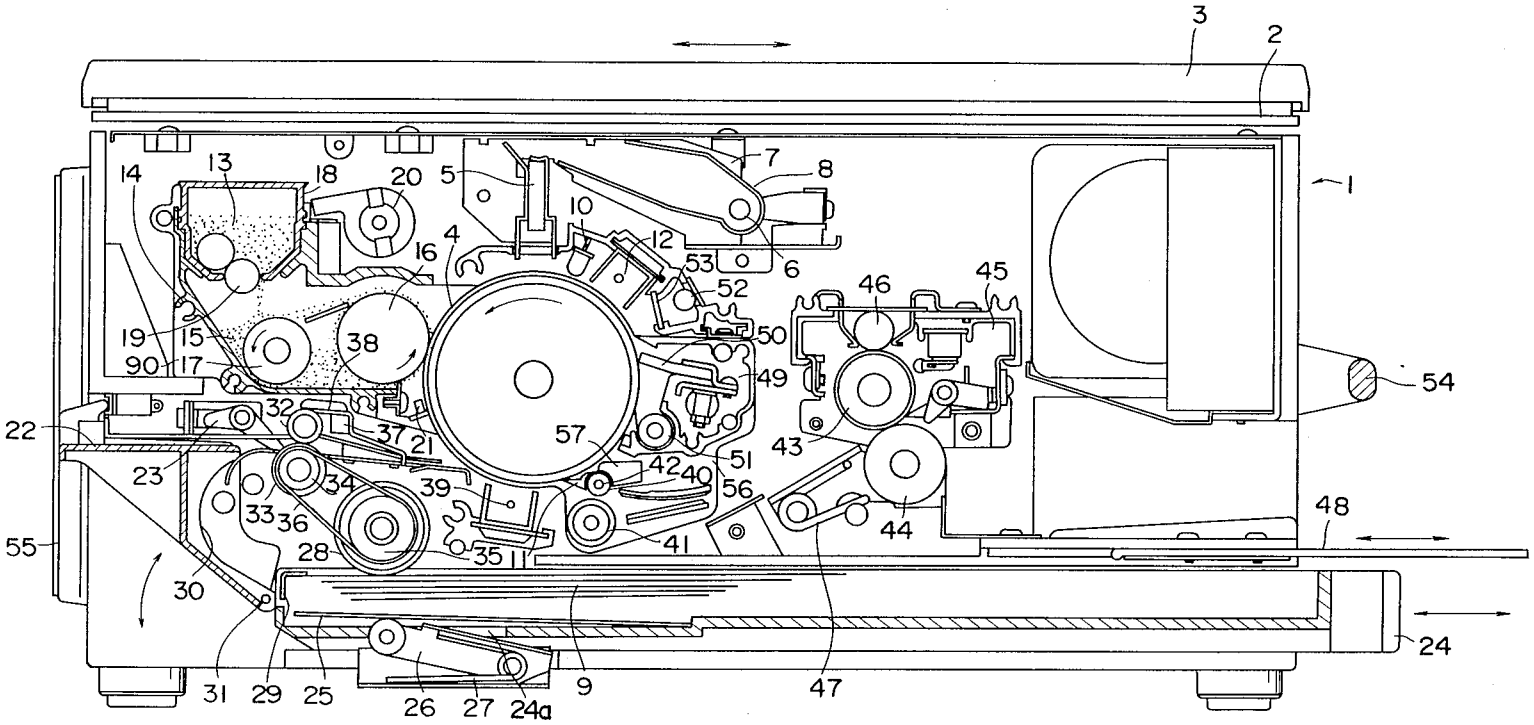
FIG. 1 is a sectional view of a first embodiment of an image forming apparatus of the invention.

FIG. 1 is a schematic sectional view of the image forming apparatus of the invention.

A body 1 of the copier of the apparatus of the present invention is formed in a casing, and on the upper surface of the body 1, an original support plate 2 formed of a transparent glass plate is mounted in relation of being slidable laterally of the body 1 in FIG. 1.

A cover 13 freely opening or closing is mounted on the upper surface of the original support plate 2 so that an original, when the copier is operated, is sandwiched between the original support plate 2 and the cover 3 so as to be scanned laterally of the body 1 of FIG. 1. The body 1 is provided at a lengthwise intermediate portion with a photosensitive drum 4 as the latent image holder coated on the outer periphery with a sensitive material of polyvinyl carbazole and rotatable counterclockwise in FIG. 1. Above the top of the photosensitive drum 4 are suspended a row of lenses 5 each of short focus length for imaging on the outer periphery of the drum 4 the original placed on the original support plate 2. An exposure lamp (halogen lamp) 6 for illuminating the surface of original is provided at the right-hand side of the row of lenses 5 each of short focus length, the row of lenses 5 and the exposure lamp 6 being fixed to the same chassis 7. In addition, reference numeral 8 designates a reflector for the exposure lamp 6. Also, upstream of the row of lenses 5 each of short focus length in the paper passing direction is provided a side erase lamp 10 for removing (side-erasing) charge at portions of the photosensitive drum 4 corresponding to the side edges of copying paper 9 as the recording paper. Such side-erasing, as discussed below, serves to peel off the copying paper 9 from the photosensitive drum 4 by a peel-off pawl 11 abutting against the aforesaid portions. Upstream of the side erase lamp 10 in the rotation direction of the photosensitive drum 4 is fixed an electrifying corotron 12 for uniformly plus-electrifying (at about 600 V) the photosensitive drum 4.

At the downstream side of the row of lenses 5 of short focus length in the rotation direction of the photosensitive drum 4 is provided a developing means 14 for developing with toner 13 the electrostatic latent images formed by the electrifying corotron 12 and the row of lenses 5, the developing means 14 containing rotatably a magnet roller 16 for conveying a developer of a mixture of toner and carrier toward the surface of the photosensitive drum 4 and a screw 17 for mixing the toner and carrier. Reference numeral 18 designates a toner hopper detachably mounted on the upper portion of the developing means 14. The toner hopper 18 is provided at the bottom thereof with a sponge roller 19 which feeds the toner 13 stored in the hopper 18 little by little to the developing means 14. Also, the toner hopper 18 is provided at the bottom thereof with a shutter (not shown) for preventing the toner 13 from leaking when the toner hopper 18 is transported, the shutter being adapted to be automatically open upon mounting the toner hopper 18 on the developing means 14.

A counter 20 is mounted in the vicinity of the toner hopper 18, which operates each time the toner hopper 18 is exchanged, thereby counting the exchange times thereof. For example, when the count value of the counter 20 is five, it is displayed on the body 1 that photosensitive drum 4 is to be exchanged. In a case where the count value of the counter 20 reaches a certain value, for example, "five" in the above example, a mechanism (not shown) for hindering a sixth exchange of toner hopper 18 is provided. At the downstream edge of the developing means 14 in the rotation direction of the photosensitive drum 4 is fixed a magnet 21 for arresting leaking carrier.

A hand-insertion paper feeder 22 is provided in the body 1 near the left side surface thereof in FIG. 1 so that the copying paper 9 is fed rightwardly of the body 1 from the hand-insertion paper feeder 22, a start switch 23 serving as a jam sensor being provided downstream of the hand-insertion paper feeder 22 in the paper passing direction.

The body 1 is detachably provided at its inner bottom with a paper feed cassette 24. The paper feed cassette 24 is inserted into the body 1 leftwardly from the right-hand surface thereof and provided at the inner bottom swingably with a support plate 25 on which the copying paper 9 is to be placed. At the bottom of the paper feed cassette 24 below the support plate 25 is provided an opening 24*a* into which a free end of a push-up lever 26 mounted swingably on the inner bottom of body 1 is insertable the push-up lever 26 carrying a torsion spring 27 to bias the push-up lever 26 to rotate clockwise, the support plate 25 being biased upwardly by the torsion spring 27.

A paper feed roller 28 for feeding the copying paper 9 one by one is provided above and near the insertion side end of the paper feed cassette 24 and urges by its empty weight the uppermost copying paper 9. Accordingly, the copying papers 9 are subjected to the empty weight of the paper feed roller 28 and sandwiched between the roller 28 and the torsion spring 27 mounted on the push-up lever 26. In addition, reference numeral 29 designates corner separators for separating the copying papers 9 one by one, which are provided at both side corners at the insertion side end of the paper feed cassette 24.

A guide 30 for U-turning upwardly the copying paper 9 fed by the paper feed cassette 24 is provided in front of the insertion side end (leftwardly thereof in FIG. 1) of the paper feed cassette 24. The guide 30 is integral with the hand-insertion paper feeder 22 so that the copying paper 9 fed from the paper feed cassette 24 passes the guide 30 and thereafter is fed as the same as when fed from the hand-insertion paper feeder 22. Also, the guide 30 is adapted to be rotatable counterclockwise from the position shown in FIG. 1 using, as the fulcrum, a support shaft 31 inserted into the lower end of the guide 30.

At the downstream side of the guide 30 in the paper passing direction are provided register rollers 32 and 33 which once stop the copying paper 9 fed from the paper feed cassette 24 or the hand-insertion paper feeder 22 and refeed it in synchronism with operation of the original support plate 2. The lower roller 33 is connected to a drive source (not shown) and rotates continuously, the lower roller 33 and paper feed roller 28 being connected with each other through two pulleys 34 and 35 and a belt 36. In addition, a clutch (not shown) is assumed to be interposed between the paper feed roller 28 and the pulley 35.

The upper roller 32 is mounted rotatably on one end (the upstream end of the paper passing direction) of a lever 38, the lever 38 is fixed to a holding shaft 37 provided rotatably at the body 1. The other end (downstream end of the paper passing direction) of the lever 38 is bent in a L-like shape so that the other end of the lever 38 can check the copying paper 9 fed from the paper feed cassette 24 or the hand-insertion paper feeder 22 at the end of paper 9 at the downstream side in the paper passing direction. In addition, the lever 38 is balanced in the lateral moments created around the holding shaft 37 so that the pair of register rollers 32 and 33 are not press-contacted with each other until the copying paper 9 arrives at the rollers. Accordingly, even when the lower roller 33 rotates continuously, the upper roller 32 is not biased to rotate, whereby the copying paper 9, which arrives merely between the register rollers 32 and 33, is not transported thereby.

However, when the downstream and in the paper passing direction of the copying paper 9 fed manually or from the paper feed roller 28 is checked by the L-like-shaped portion of the lever 38, the lever 38 is given a moment created counter clockwise in FIG. 1 around the holding shaft 37 so that the register rollers 32 and 33 put therebetween the copying paper 9 to apply it a passing force, but in this condition, the copying paper 9 is not given the passing force enough to slidably pass below the lever 38. Hence, the copying paper 9 is kept stationary in condition of abutting at its downstream edge against the L-like-shaped portion of the lever 38, and then with the timing for operation of the original support plate 2, a plunger (not shown) mounted on the lever 38 gives thereto the counterclockwise moment, at which time the copying paper 9 is sandwiched under sufficient pressure by the pair of register rollers 32 and 33 and given a feeding force enough to pass through the L-like-shaped portion at the lever 38, thereby being fed toward the photosensitive drum 4.

A transfer corotron 39 as the transfer means to transfer to the copying paper 9 the toner image developed by the developing means 14 is provided below and opposite to the photosensitive drum 4, and downstream of the transfer corotron 39 in the rotation direction of the photosensitive drum 4 is disposed adjacently to the corotron 39 the peel-off pawl 11 for peeling the copying paper 9 from the photosensitive drum 4, the peel-off pawl 11 being mounted rotatably on a support shaft 42 of an upper roller 40 of a pair of transfer rollers 40 and 41.

Figure 2:
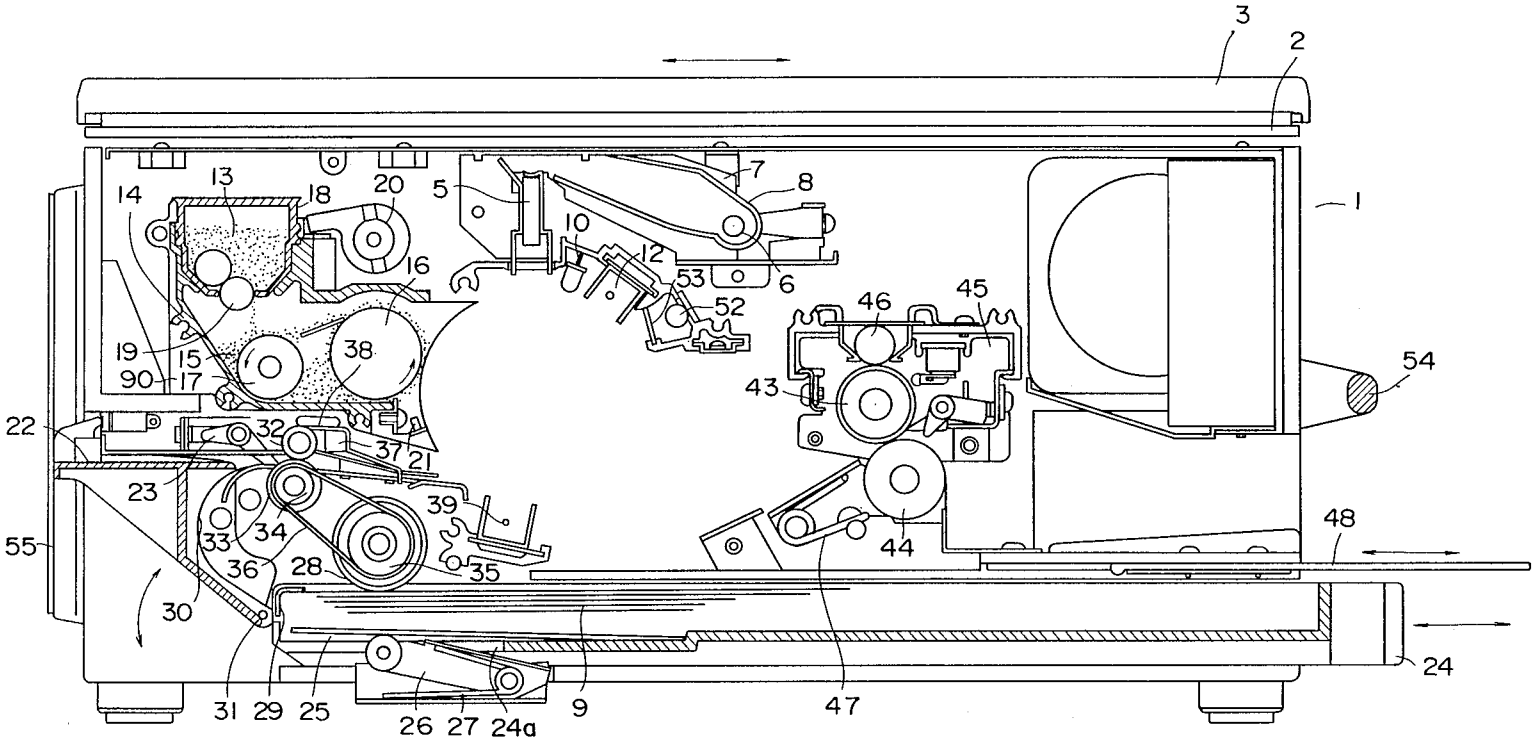
FIG. 2 is a sectional view exemplary of the apparatus of the invention, from which a unit comprising a latent image holder and a cleaning means is removed from the body of the apparatus.
Figure 3:
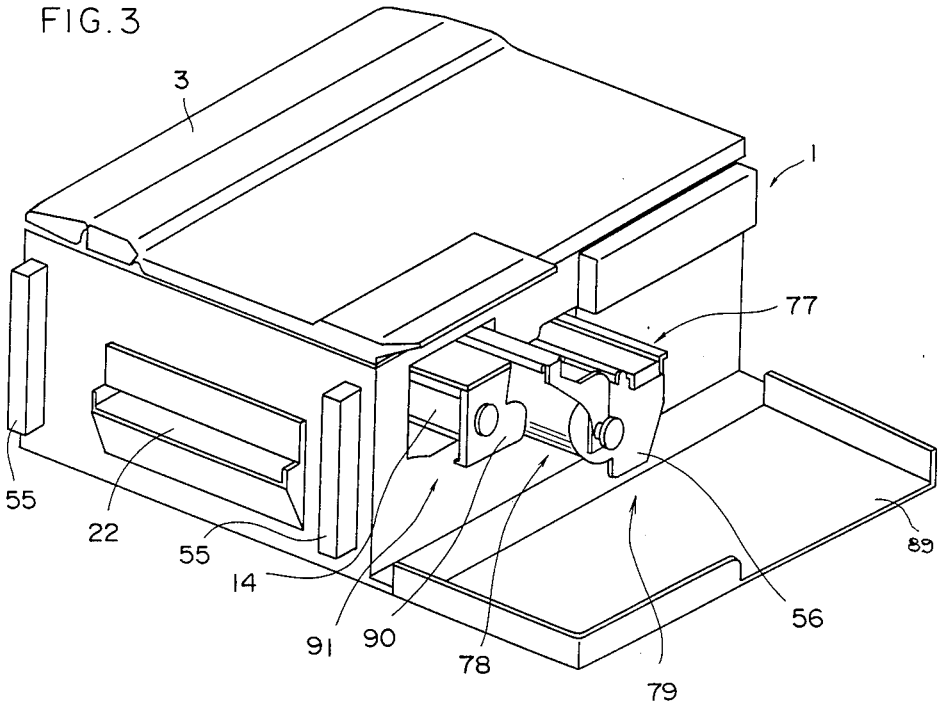
FIG. 3 is a perspective view exemplary of the apparatus of the invention.

Now, in the apparatus of the invention, the aforesaid developing means 14 together with the toner hopper 18 is incorporated as a developing unit 91 in a chassis 90, and the photosensitive drum 4 and a cleaning means 49 to be discussed below are incorporated as a process kit 79 in a common chassis 56, both the chassis 90 and 56 being mounted on the front side of body 1 in relation of freely projecting therefrom and retracting therein as shown in FIG. 3. In addition, FIG. 2 shows the body 1 from which the chassis 56 is removed, in other words, the process kit 79 comprising the photosensitive drum 4, cleaning means 49 and peripheral devices thereof, is removed from the body 1, and FIG. 3 shows a process kit 79 having the main components comprising the developing unit 91 incorporated in the chassis 90, and the photosensitive drum 4 and the cleaning means 49, which are incorporated in the chassis 56, in which a cover at the front side of body 1 is open to draw the process kit 79 little by little out of the body 1.

Next, explanation will be given on construction of the process kit 79.

Figure 4:
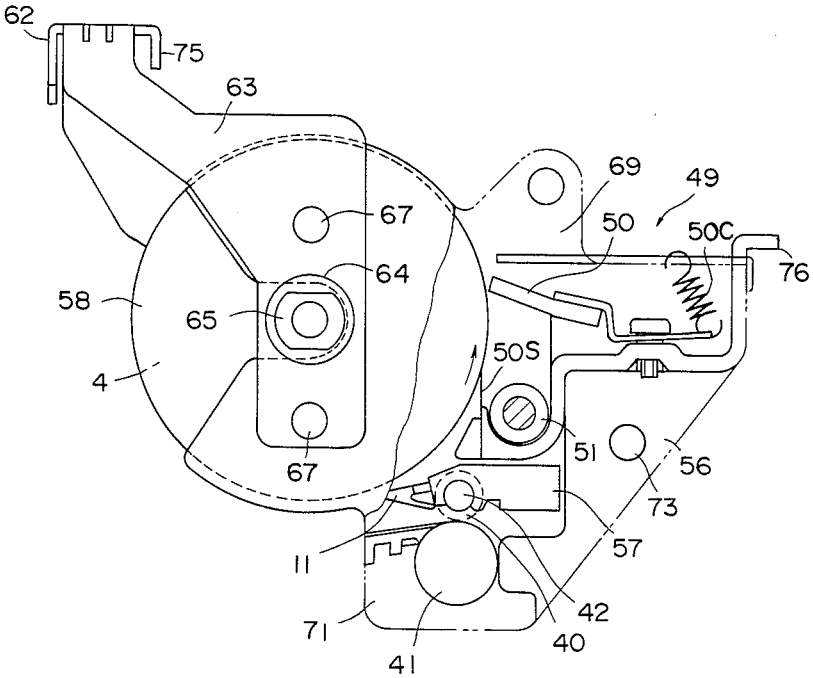
FIG. 4 is a partially cutaway view of the unit comprising the latent image holder and cleaning means.
Figure 5:
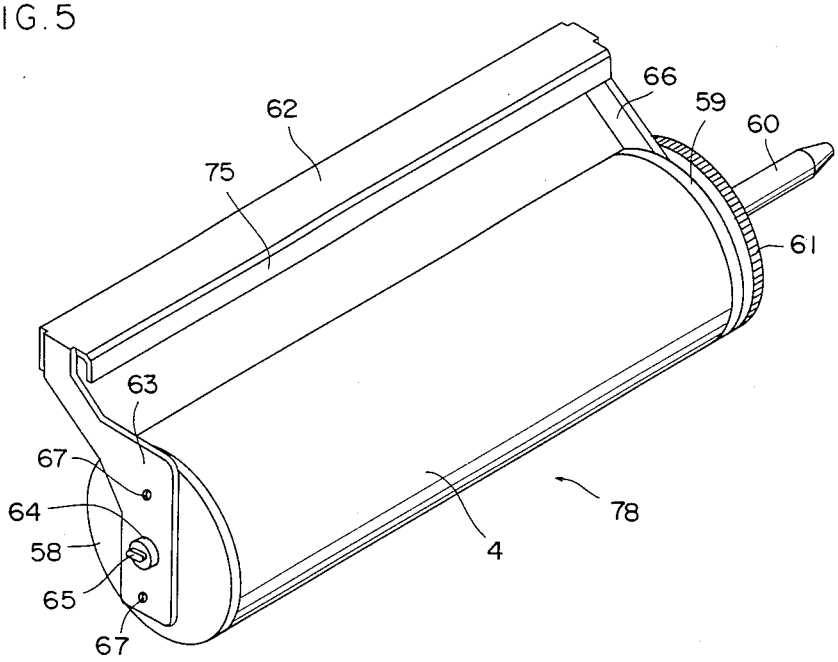
FIG. 5 is a perspective view exemplary of the latent image holder unit.
Figure 6:
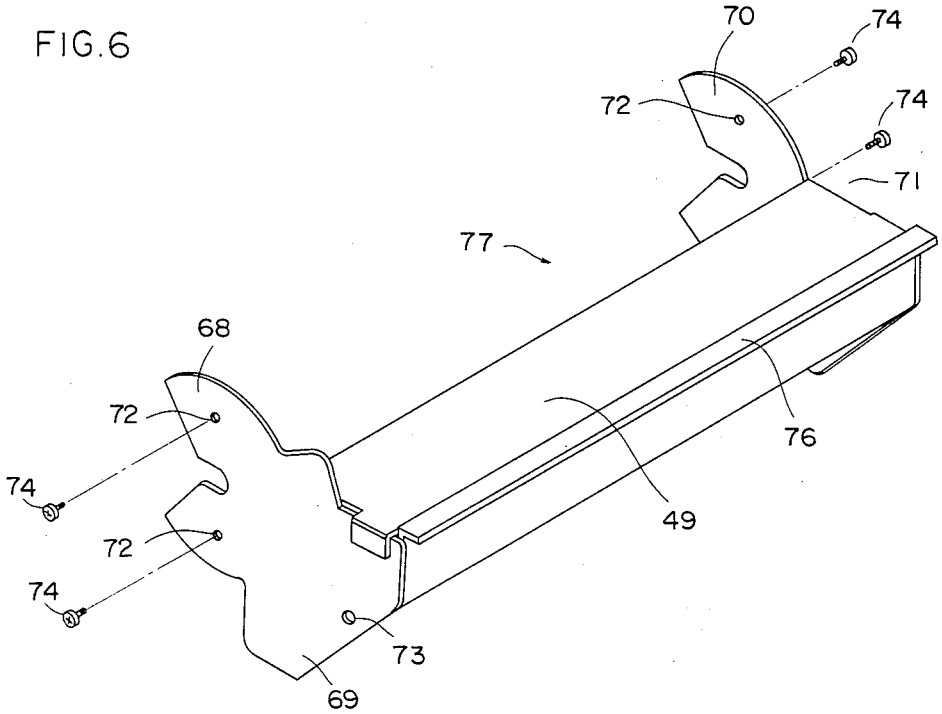
FIG. 6 is a perspective view exemplary of the cleaning unit.
Figure 7:
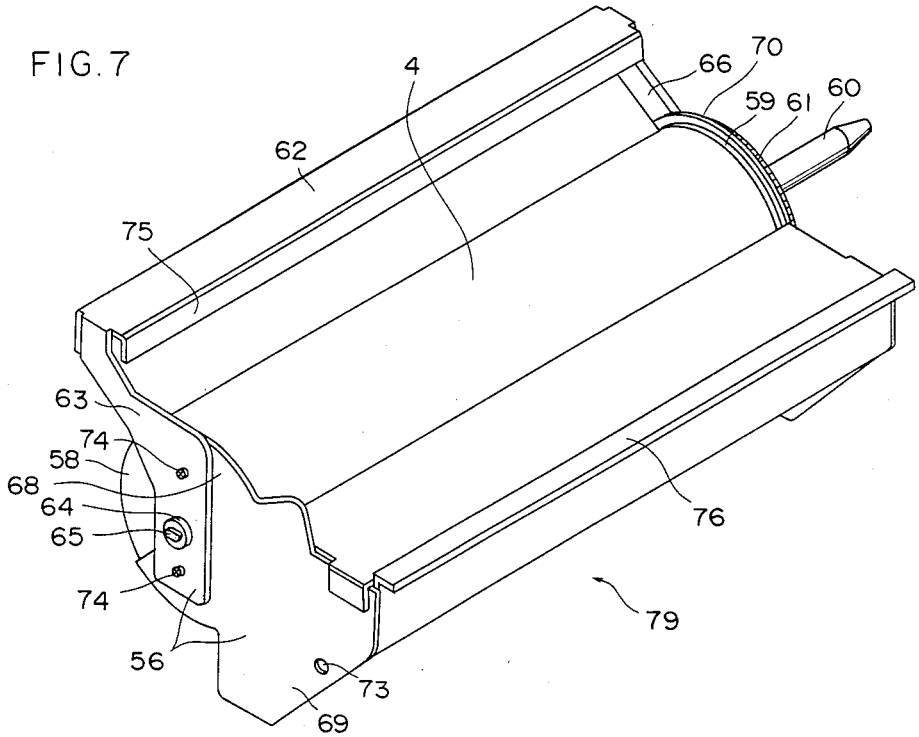
FIG. 7 is a perspective view exemplary of the unit comprising the latent image holder and cleaning means.

In addition, FIG. 4 is a side view of the process kit 79 when viewed from front side of body 1, FIGS. 5 and 6 are perspective views exemplary of the process kit 79 divided into a drum unit 78 and a cleaning unit 77, and FIG. 7 is a perspective view of the same which couples both the above members with each other.

The drum unit 78, as shown in FIG. 5, comprises the photosensitive drum 4 as the latent image holder, a drum holder 62 for rotatably supporting the photosensitive drum 4, and a spur gear 61 for rotating the same.

The photosensitive drum 4 has a front flange 58 press-fitted into an opening at one end of drum 4 at the front side of body 1 and a rear flange 59 fitted into an opening at the other end at the back of body 1, both the flanges 58 and 59 providing projections 65 and 60 for positioning the photosensitive drum 4.

The spur gear 61 is mounted on the projection 60 somewhat apart from the rear flange 59 and rotary-driven by a drive gear (not shown) to rotate the photosensitive drum 4 which is held rotatably by the drum holder 62. Concretely, the drum holder 62 has at both lengthwise ends an arm-like front chassis 63 and an arm-like rear chassis 66, the front chassis 63 being mounted on the projection 65 at the front flange 58 through a hollow shaft 64, the rear chassis 66 being mounted on the projection 60 between the spur gear 61 and the photosensitive drum 4 through a hollow shaft (not shown, but the same as the hollow shaft 64). Also, the front chassis 63 and rear chassis 66 of the drum holder 62 are provided at each two positions with threaded bores 67, 67 . . . (those at the rear chassis 66 are not shown) for coupling with the cleaning unit 77.

The cleaning unit 77, as shown in FIG. 6, comprises the cleaning means 49 and front and rear chassis 69 and 71 for carrying the cleaning means 49 and for coupling through both the chassis 69 and 71 with the drum unit 78.

The cleaning means 49 serves to erase toner not completely transferred to the copying paper 9 but remaining on the photosensitive drum 4, and as shown in the FIG. 4 sectional view, comprises a rubber blade 50 and a screw conveyor 51 for discharging toward the front of body 1 the toner scratched by the blade 50 from the surface of photosensitive drum 4, the blade 50 being in press-contact at the utmost end with the surface of photosensitive drum 4 by means of a coiled spring 50C. In addition, in FIG. 4, reference numeral 50S designates a sealing member for guiding to the screw conveyor 51 the toner scratched by the blade 50.

Thus, the cleaning means 49 constructed foregoing is sandwiched between the front chassis 69 and the rear chassis 71 so as to constitute the cleaning unit 77.

The front chassis 69 and rear chassis 71 integrally form semi-circular drum unit front mounting portion 68 and semi-circular drum unit rear mounting portion 70 respectively.

Incidentally, the drum unit front and rear mounting portions 68 and 70 are provided with threaded bores 72, 72 . . . respectively, so that the bores 72, 72 . . . are aligned with the threaded bores 67, 67 . . . provided at the front and rear chassis 63 and 66 of the drum holder 62 and screwably tightened by screws 74 respectively.

In the drawing, reference numeral 73 designates an outlet for waste toner scratched by the cleaning means 49 from the surface of the photosensitive drum 4.

The drum unit 78 and cleaning unit 77 constructed as above-mentioned are coupled with each other as described below so as to be assembled as the process kit 79 as shown in FIG. 7.

At first, the drum unit front mounting portion 68 and rear mounting portion 70 are inserted inside the front chassis 63 and rear chassis 66 of the drum holder 62 respectively. The threaded bores 67 and 72, and 67 and 72, . . . at these members are aligned with each other and screwed by screws 74, 74 . . . respectively. Hence, the front chassis 63 of the drum holder 62 and the front chassis 69 of the cleaning unit 77, and the rear chassis 66 of the drum holder 62 and the rear chassis 71 of the cleaning unit 77, are coupled integrally with each other to form the chassis 56 and the drum unit 78 is integral with the cleaning unit 77 to form the process kit 79.

Thus, the screws 74, 74 . . . are attached or removed to or from the process kit 79 so as to make it possible to easily and desirably couple or separate the drum unit 78 and cleaning unit 77. Accordingly, for example, when the cleaning means 49 is injured but the photosensitive drum 4 is still normal, the cleaning unit 77 need only be exchanged.

Incidentally, the process kit 79 comprising the drum unit 78 and cleaning unit 77 integral with each other, is held slidably on a rail (not shown) at the body 1 by a guide 75 provided at the drum holder 62 axially of the photosensitive drum 4 and a guide 76 provided at the cleaning unit 77 and extending lengthwise thereof.

Figure 8:
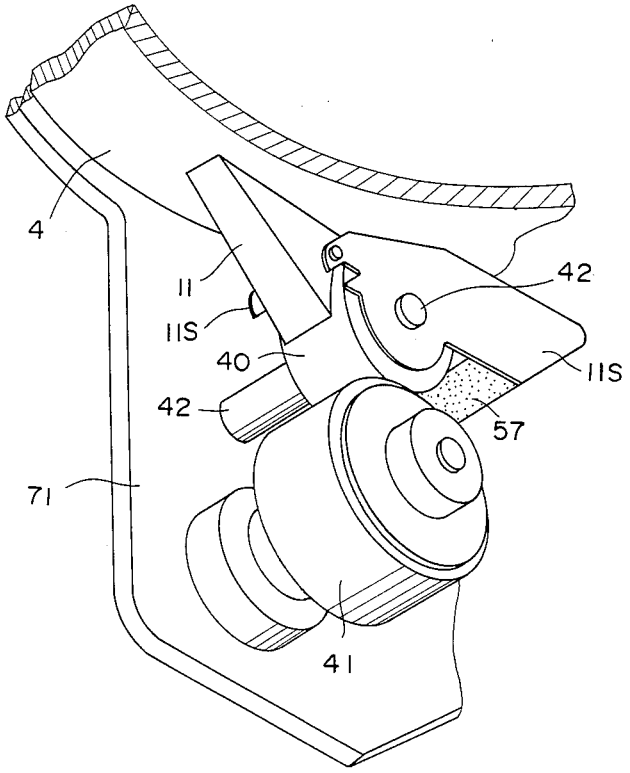
FIG. 8 is a view exemplary of construction around a peel-off pawl.

FIG. 8 shows the transfer rollers 40 and 41 and peel-off pawl 11 arranged near the back end of the photosensitive drum 4, when viewed from the leftwardly front side and below of the body 1.

Side plates 11S, 11S are rotatably mounted on the support shaft 42 for the upper roller 40 in relation of sandwiching the roller 40 at both the axial sides thereof, the peel-off pawl 11 being put between the side plates 11S, 11S and at the upstream side in the paper passing direction (the left side in FIG. 8). Between both the side plates 11S, 11S and at the reverse side to the peel-off pawl 11 is attached a weight 57, and the utmost end of peel-off pawl 11 at the upstream side in the paper passing direction is formed in an acute angle and in a bill-like shape.

Hence, the utmost end of peel-off pawl 11 at the upstream side in the paper passing direction is biased onto the surface of the photosensitive drum 4 always under constant pressure by means of rotation moment of the weight 57, thereby enabling the copying paper 9 to be stably peeled off from the surface of photosensitive drum 4.

At the downstream side of the transfer rollers 40, 41 in the paper passing direction is provided a fixing means 45 comprising a heating roller 43 insertably supporting therein a halogen lamp of about 800 W and a pressure roller 44 in press-contact with the heating roller 43. An oil feeding pipe 46 for feeding silicon oil to the heating roller 43 is provided to be in light press-contact with the upper portion thereof and forms at the wall of the oil feeding pipe 46 fine continuous bubbles each containing therein silicon oil. Hence, the silicon oil in the oil feeding pipe 46 permeates through the wall of the oil feeding pipe 46 to be supplied gradually onto the heating roller 43. At the left side of the pressure roller 44 is provided a torsion spring (not shown) to bias the pressure roller 44 counterclockwise in FIGS. 1, 2 and 3, toward the heating roller 43.

Now, the copying paper 9 fixed with the toner image by the fixing means 45 is discharged onto a paper discharge tray 48 provided above the paper feed cassette 24, the paper discharge tray 48 freely projecting or retracting from or into the body 1, thereby being retracted therein as a whole and projected from the body 1 when not in use.

At the downstream side (upwardly in FIG. 1) of the peel-off pawl 11 in the rotation direction of the photosensitive drum 4 is provided a cleaning means 49 as above-mentioned.

Also, at the downstream side (upwardly in FIG. 1) of the cleaning means 49 in the rotation direction of the photosensitive drum 4 is provided an eraser lamp 52 for completely erasing the residual charge on the photosensitive drum 4. In addition, reference number 53 designates a filter for the eraser lamp 52.

At the right-hand surface of the body 1, i.e., at the side thereof on which the paper discharge tray 48 and the paper feed cassette 24 are mounted, a handle 54 for lifting up and carrying the apparatus of the invention is fixed.

Furthermore, at the outer surface of the opposite side (the left-hand surface) of the body 1 to the above handle fixing side and at two lateral portions right-prism-like-shaped rubber cushion 55 extending vertically are fixed, the rubber cushions 55 serving as the support legs and to protect the body 1 when lifted as a whole and placed on the desk or the like.

Next, explanation will be given on operation of the image forming apparatus of the invention.

At first, an original is placed on the original support plate 2, and thereafter upon turning a copy start switch (not shown) on, the original support plate 2 once moved rightwardly in FIG. 1 because the apparatus of the invention provides a lens system and the photosensitive drum 4 as the latent image holder at the central portion of the body 1 in the moving direction of the original support plate 2, and then moves leftwardly, and again rightwardly to thereby return to the initial position. During the rightward movement, the original image is projected and image-formed on the photosensitive drum 4 so that the latent images corresponding to the original image is formed on the same. The latent images are toner-developed by the developing means 14, the toner images being transferred by the transfer corotron 39 as the transfer means onto the copying paper 9 fed from the paper feed cassette 24. Thus, the copying paper 9 bearing the transferred toner images is peeled off by the peel-off pawl 11 from the photosensitive drum 4 and subjected to heating and application of pressure at the fixing means 45 so as to be fixed, the fixed copying paper 9 being placed on the paper discharge tray 48. In addition, the residual charge and the toner not thoroughly transferred but remaining on the photosensitive drum 4 are removed by the cleaning means 49 and the eraser lamp 52.

As seen from the above, in the image forming apparatus of the invention, since the process kit 79 is easy to separate into the drum unit 78 including the photosensitive drum 4 as the latent image holder and the cleaning unit 77 including the cleaning means 49, only either one or both the units 78 and 77 is exchangeable. Also, since the peel-off pawl 11 for peeling off the copying paper 9 from the photosensitive drum 4 is mounted on the chassis 56 of the process kit 79 carrying the photosensitive drum 4, the peel-off pawl 11, even when the process kit 79 is mounted or dismounted to or from the body 1 for exchanging the photosensitive drum 4, does not injure the surface thereof. Also, since the peel-off pawl 11 and photosensitive drum 4 keep the positional relation therebetween always constant, the copying paper 9 is stably peeled off from the photosensitive drum 4.

Figure 9:
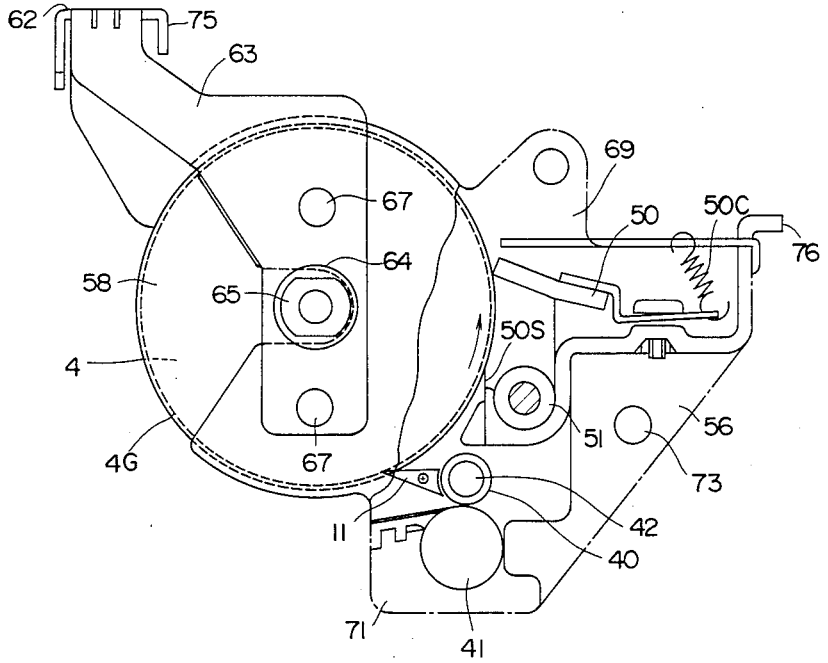
FIGS. 9 and 10 show a second embodiment of the invention, FIG. 9 corresponding to FIG. 4 and FIG. 10 to FIG. 8.
Figure 10:
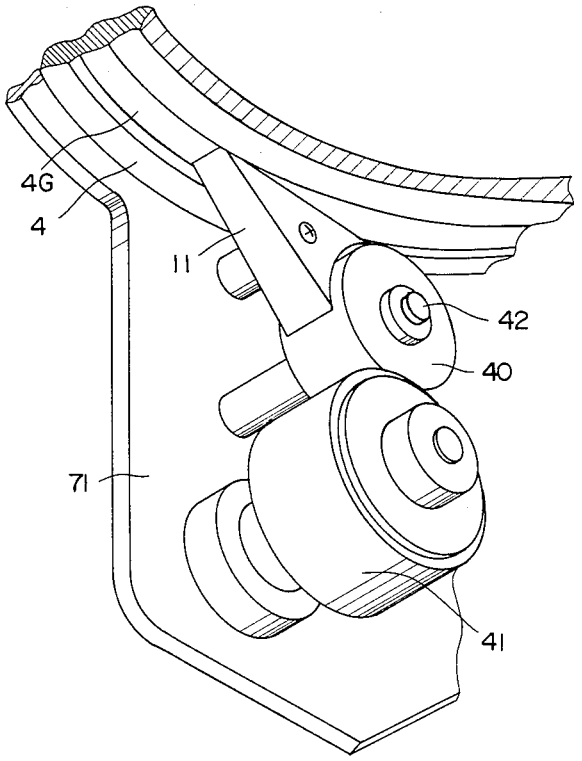

A second embodiment of the image forming apparatus of the invention is shown in FIGS. 9 and 10, in which the components the same as those in the first embodiment in FIGS. 4 and 8 are shown.

In this embodiment, an annular groove 4G is provided at the outer periphery of the back end of the photosensitive drum 4. The support shaft 42 different from that in the first embodiment, supports the upper transfer roller 40 only, the peel-off pawl 11 being fixed at the back side chassis 71 of the cleaning unit 77 in relation of being put into the groove 4G. Hence, this embodiment of such construction ensures peeling-off of copying paper 9 from the photosensitive drum 4.

Also, in a case of exchaning the photosensitive drum 4 in this embodiment, at first a user takes out the process kit 79 from body 1 by taking out the chassis 56 from the body 1, whereby the photosensitive drum 4, cleaning means 49 and peel-off pawl 11, in condition of being mounted together on the chassis 56, are taken out from the body 1.

Hence, in condition of taking out the process kit 79 integral with the chassis 56 from the body 1, the peel-off pawl 11 is taken out from the chassis 56 (the rear chassis 71 at the cleaning unit 77) and thereafter the photosensitive drum 4 becomes easy to exchange.

As this invention may be embodied in several forms without departing from the spirit of essential characteristics thereof, the present embodiment is therefore illustrative and not restrictive, since the scope of the invention is defined by the appended claims rather than by the description preceeding them, and all changes that fall within meets and bounds of the claims, or equivlanece of such meets and bounds thereof are therefore intended to be embraced by the claims.

What is claimed is:

1. An image forming apparatus including a latent image holder which forms on the surface thereof latent images, develops said latent images by toner, and transfers said toner images to a recording paper; and a cleaning means for removing the residual toner from said latent image holder; said latent image holder and cleaning means being coupled integrally with a chassis mounted detachably on a body, wherein the improvement comprises:

said latent image holder and said cleaning means being detachably coupled with each other;

said chassis including first and second auxiliary chassis on which said latent image holder and cleaning means are mounted, respectively, said first and second auxiliary chassis being coupled detachably and integrally with each other; and said second auxiliary chassis being provided with peel-off means for peeling off from said latent image holder said recording paper attached thereto.

2. The image forming apparatus of claim 1, wherein said peel-off means consists of a peel-off pawl.

3. An image forming apparatus as set forth in claim 2, wherein said peel-off pawl is pivotally supported to a support shaft provided at said chassis and extending axially in parallel to a rotary shaft for said latent image holder.

4. An image forming apparatus as set forth in claim 3, wherein a pair of rollers for passing said recording paper after said toner images are transferred thereon are mounted rotatably on said chassis.

5. An image forming apparatus as set forth in claim 3, wherein said peel-off pawl is put at the upstream side end thereof in the paper passing direction into a groove provided circumferentially on one axial end of said latent image holder.

6. The image forming apparatus of claim 3, wherein a pair of transfer rollers are mounted on said second auxiliary chassis, whereby a support shaft attached to said second auxiliary chassis supports said peel-off pawl, and one of said rollers.

7. An image forming apparatus as set forth in claim 2, wherein the end of said peel-off pawl at the upstream side in the paper passing direction is formed in acute angle and said peel-off pawl is given a biasing force so as to be biased onto the surface of said latent image holder.

8. An image forming apparatus as set forth in claim 7, wherein said biasing force is rotation moment caused by a weight provided at the reverse side beyong said support shaft to the end of said peel-off pawl at the upstream side in the upper passing direction.

9. An image forming apparatus which develops with toner latent images formed on the surface of a latent image holder, said toner images being transferred onto a recording paper, wherein the improvement comprises said latent image holder being mounted on a chassis detachably mounted on a body, said chassis being provided with peel-off means for peeling off from said latent image holder said recording paper attached thereto, and a pair of rollers positioned with respect to said peel-off means for receiving said recording paper therefrom, for passing said recording paper away from said latent image holder, said peel-off means being wholly located between said latent image holder and the one of said pair of rollers closest to said latent image holder.

10. An image forming apparatus as set forth in claim 9 wherein said chassis is provided with a cleaning means.

11. An image forming apparatus which develops with toner latent images formed on the surface of a latent image holder, said toner images being transferred onto a recording paper, wherein the improvement comprises said latent image holder being mounted on a chassis detachably mounted on a body, said chassis including two auxiliary chassis, one of said auxiliary chassis being provided with and supporting both peel-off means for peeling off from said latent image holder said recording paper attached thereto, and a pair of rollers for passing said recording paper after said toner images are transferred thereon, the other of said auxiliary chassis being provided with and supporting said latent image holder.

12. An image forming apparatus as set forth in claim 11, wherein said pair of rollers are aligned with said peel-off means.

13. An image forming apparatus as set forth in claim 11, wherein said chassis is provided with a cleaning means, with said cleaning means being supporting on the same auxiliary chassis on which said peel-off means and pair of rollers are supported.

* * * * *